US007670265B1

(12) United States Patent
Forrest et al.

(10) Patent No.: US 7,670,265 B1
(45) Date of Patent: Mar. 2, 2010

(54) HANDLE-PASS TRAINER METHOD AND APPARATUS

(76) Inventors: Christopher Forrest, 9567 Cypress Park Way, Boynton Beach, FL (US) 33437; Chad Forrest, 9567 Cypress Park Way, Boynton Beach, FL (US) 33437

( * ) Notice: Subject to any disclaimer, the term of this patent is extended or adjusted under 35 U.S.C. 154(b) by 0 days.

(21) Appl. No.: 11/751,983

(22) Filed: May 22, 2007

Related U.S. Application Data

(60) Provisional application No. 60/802,393, filed on May 23, 2006.

(51) Int. Cl.
*A63B 22/00* (2006.01)

(52) U.S. Cl. ..... 482/51; 482/34; 482/146

(58) Field of Classification Search ..... 482/34, 482/79, 80, 121, 122, 129, 130, 142, 146, 482/147, 171, 71, 51; D21/688, 689
See application file for complete search history.

(56) References Cited

U.S. PATENT DOCUMENTS 1,585,748 A * 5/1926 Wendelken ..... 482/143
5,062,629 A * 11/1991 Vaughan ..... 482/51
6,168,551 B1 * 1/2001 McGuinness ..... 482/51
6,543,769 B1 * 4/2003 Podoloff et al. ..... 273/148 B
6,695,755 B1 * 2/2004 Huang ..... 482/146
6,702,726 B2 * 3/2004 Lin ..... 482/148
6,872,175 B2 * 3/2005 Lin ..... 482/146
7,288,055 B2 * 10/2007 Blaum ..... 482/142
2004/0142802 A1 * 7/2004 Greenspan et al. ..... 482/146
2007/0155603 A1 * 7/2007 Cook ..... 482/142

* cited by examiner

*Primary Examiner*—Loan H Thanh
*Assistant Examiner*—Tam Nguyen
(74) *Attorney, Agent, or Firm*—Gold & Rizvi, P.A.; Glenn E. Gold; H. John Rizvi

(57) ABSTRACT

A handle toss training apparatus can be utilized to aid in improving a person's balance, coordination, and skills respective to a maneuver commonly referred to as a handle pass. The handle toss training apparatus includes a balancing board with a base. The base provides a rotational, a rolling, and a pitch motion for the balancing board. A handle is fastened to a wall via a cable. Tension for the handle is created by the specific material used for fabrication of the cable or by a variable weight system.

17 Claims, 11 Drawing Sheets

HANDLE-PASS TRAINER METHOD AND APPARATUS

CROSS-REFERENCE TO RELATED APPLICATION

The application claims the benefit of U.S. Provisional Patent Application Ser. No. 60/802,393, filed on May 23, 2006, which is incorporated herein in its entirety.

FIELD OF THE INVENTION

The present invention relates generally to the field of sports and exercise equipment, more specifically to a training device for improving the balance and coordination required to perform a handle pass.

BACKGROUND OF THE INVENTION

Balance boards are devices are meant to train and strengthen muscle groups used to maintain balance. There have been a number of balancing boards developed over the years. Some are meant for skating, surfing, siding, snowboarding, and the like. The basic design usually involves a platform and a member that acts as a pivot point. The pivot point can be stationary or moveable. Generally, balance boards only pivot along a single axis. These devices do not give a realistic reproduction of total balance. Balancing boards are currently designed simply for training a user for balance; none have been integrated for handle-pass training.

Extreme water sports are very popular and growing fast today. Our device is mainly aimed at wakeboarding, wakeskating, and kiteboarding. Wakeboarding and wakeskating are both performed by holding on to a rope being pulled behind a boat or by a self-powered cable, while standing on a board that planes on the surface of the water. Kiteboarding utilizes a kite as the means for propelling the user through the water. These sports are very progressive, including rotations, aerial spins, flips, and the like. While in the air, the user is required to pass the handle from one hand to the other while spinning or flipping, often behind the back. This requires a great amount of skill, coordination, and balance.

What is desired is a training device for improving a person's balance, coordination, and skills respective to a maneuver commonly referred to as a handle pass.

SUMMARY OF THE INVENTION

One aspect of the present invention is a balancing board.

Yet, another aspect of the present invention is a balancing board placed upon a top surface of a domed support member.

Yet, another aspect of the present invention is a balancing board placed upon a top surface of a domed support member, said domed support member providing a roll along a longitudinal axis.

Yet, another aspect of the present invention is a balancing board placed upon a top surface of a domed support member, said domed support member providing a pitch along a latitudinal axis.

Yet, another aspect of the present invention is a balancing board placed upon a top surface of a domed support member, said domed support member comprising a domed upper surface and a planar bottom surface.

Yet, another aspect of the present invention is a balancing board placed upon a top surface of a domed support member, said domed support member comprising a textured upper surface.

Yet, another aspect of the present invention is a balancing board placed upon a top surface of a domed support member, said domed support member comprising a textured upper surface, said textured upper surface comprising a plurality of raised rings.

Yet, another aspect of the present invention is a balancing board placed upon a top surface of a domed support member, said domed support member comprising a textured bottom surface.

Yet, another aspect of the present invention is a balancing board placed upon a top surface of a domed support member, said domed support member comprising a textured bottom surface, said textured bottom surface comprising a plurality of protrusions.

Yet, another aspect of the present invention is a balancing board is provided a horizontal, rotational motion via a rotational base member.

Yet, another aspect of the present invention is a balancing board is provided a horizontal, rotational motion via a rotational base member, said rotational base member comprising a planar bearing set, commonly used on a "Lazy Susan".

Yet, another aspect of the present invention is a balancing board is provided a horizontal, rotational motion via a rotational base member, said rotational base member comprising a planar bearing set coupled to a planar base plate.

Yet, another aspect of the present invention is a balancing board is provided a horizontal, rotational motion via a rotational base member, said rotational base member comprising a planar bearing set coupled to a planar base plate, said planar base plate being fabricated of plywood.

Yet, another aspect of the present invention is a balancing board is provided a horizontal, rotational motion via a rotational base member, said rotational base member comprising a planar bearing set coupled to a planar base plate, said planar base plate being fabricated of plywood and covered with an aesthetically pleasing material, such as fabric, paint, and the like.

Yet, another aspect of the present invention is a balancing board is provided a horizontal, rotational motion via a rotational base member, said rotational base member comprising a planar bearing set coupled to a planar base plate, said planar base plate being fabricated of metal, a polymer, and the like.

Yet, another aspect of the present invention is a balancing board is provided a horizontal, rotational motion via a rotational base member, said rotational base member being coupled to a planar top plate.

Yet, another aspect of the present invention is a balancing board is provided a horizontal, rotational motion via a rotational base member, said rotational base member being coupled to a planar top plate, said planar top member further comprising a padding.

Yet, another aspect of the present invention is a balancing board is provided a horizontal, rotational motion via a rotational base member, said rotational base member being coupled to a planar top plate, said planar top member further comprising a padding, covered with a material.

Yet, another aspect of the present invention is a balancing board, said balancing board in a shape resembling a wakeboard, and said wakeboard being an elongated rectangle with a center section that is wider than the narrow edge.

Yet, another aspect of the present invention is a balancing board, said balancing board in a shape resembling a wakeboard, said wakeboard being an elongated rectangle with a center section that is wider than the narrow edge, and having a curved cross sectional shape along the longer side said wakeboard.

Yet, another aspect of the present invention is a balancing board, said balancing board in a shape resembling a kite-board.

Yet, another aspect of the present invention is a balancing board, said balancing board in a shape resembling a wakeskate.

Yet, another aspect of the present invention is a balancing board, said balancing board is fabricated of at least one of:

a. wood;
b. plywood;
c. polymer;
d. fiberglass covered foam;
e. epoxy covered foam;
f. plastic; and
g. molded plastic.

Yet, another aspect of the present invention is handle, said handle is secured via a cable to an object positioned distant from said balancing board.

Yet, another aspect of the present invention is handle, said handle is secured via a cable to a wall positioned distant from said balancing board.

Yet, another aspect of the present invention is handle, said handle is secured via a cable to a wall via a coupling member.

Yet, another aspect of the present invention is handle, said handle secured to a wall via a coupling member, said coupling member is a coupling loop.

Yet, another aspect of the present invention is handle, said handle is secured via a cable to a wall via a coupling member, said coupling member is a pulley, wherein said pulley redirects a cable from said handle to a weight.

Yet, another aspect of the present invention is handle, said handle is secured via a cable to a wall via a coupling member, said coupling member is a pulley, wherein said pulley redirects a cable from said handle to a series of weights, said series of weights allowing a user to adjust the coupled total weight.

Yet, another aspect of the present invention is a handle toss training method comprising the following steps:

a. Assemble the balancing board assembly;
b. Taking hold of the handle;
c. Getting onto and standing upon the balancing board assembly;
d. Practicing the Handle Toss using the handle that is secured to a distant object as a replication of cable tension from being coupled to a boat or other force providing item; and
e. Utilizing the handle/cable as an assistant for balancing one self.

Yet, another aspect of the present invention is a handle toss training method comprising the following steps:

a. Assemble the balancing board assembly;
b. Taking hold of the handle;
c. Getting onto and standing upon the balancing board assembly;
d. Rotating said balancing board on a horizontal plane;
e. Practicing the Handle Toss using the handle that is secured to a distant object as a replication of cable tension from being coupled to a boat or other force providing item; and
f. Utilizing the handle/cable as an assistant for balancing one self.

Yet, another aspect of the present invention is a handle toss training method comprising the following steps:

a. Assemble the balancing board assembly;
b. Taking hold of the handle;
c. Getting onto and standing upon the balancing board assembly;
d. Rolling said balancing board about at least one of a longitudinal line and a latitudinal line;
e. Practicing the Handle Toss using the handle that is secured to a distant object as a replication of cable tension from being coupled to a boat or other force providing item; and
f. Utilizing the handle/cable as an assistant for balancing one self.

Yet, another aspect of the present invention is a handle toss training method comprising the following steps:

a. Assemble the balancing board assembly;
b. Taking hold of the handle;
c. Getting onto and standing upon the balancing board assembly;
d. Rotating said balancing board on a horizontal plane;
e. Rolling said balancing board about at least one of a longitudinal line and a latitudinal line;
f. Practicing the Handle Toss using the handle that is secured to a distant object as a replication of cable tension from being coupled to a boat or other force providing item; and
g. Utilizing the handle/cable as an assistant for balancing one self.

It is recognized that the various aspects presented herein can be combined.

DETAILED DESCRIPTION OF THE PREFERRED EMBODIMENTS

Figure 1:
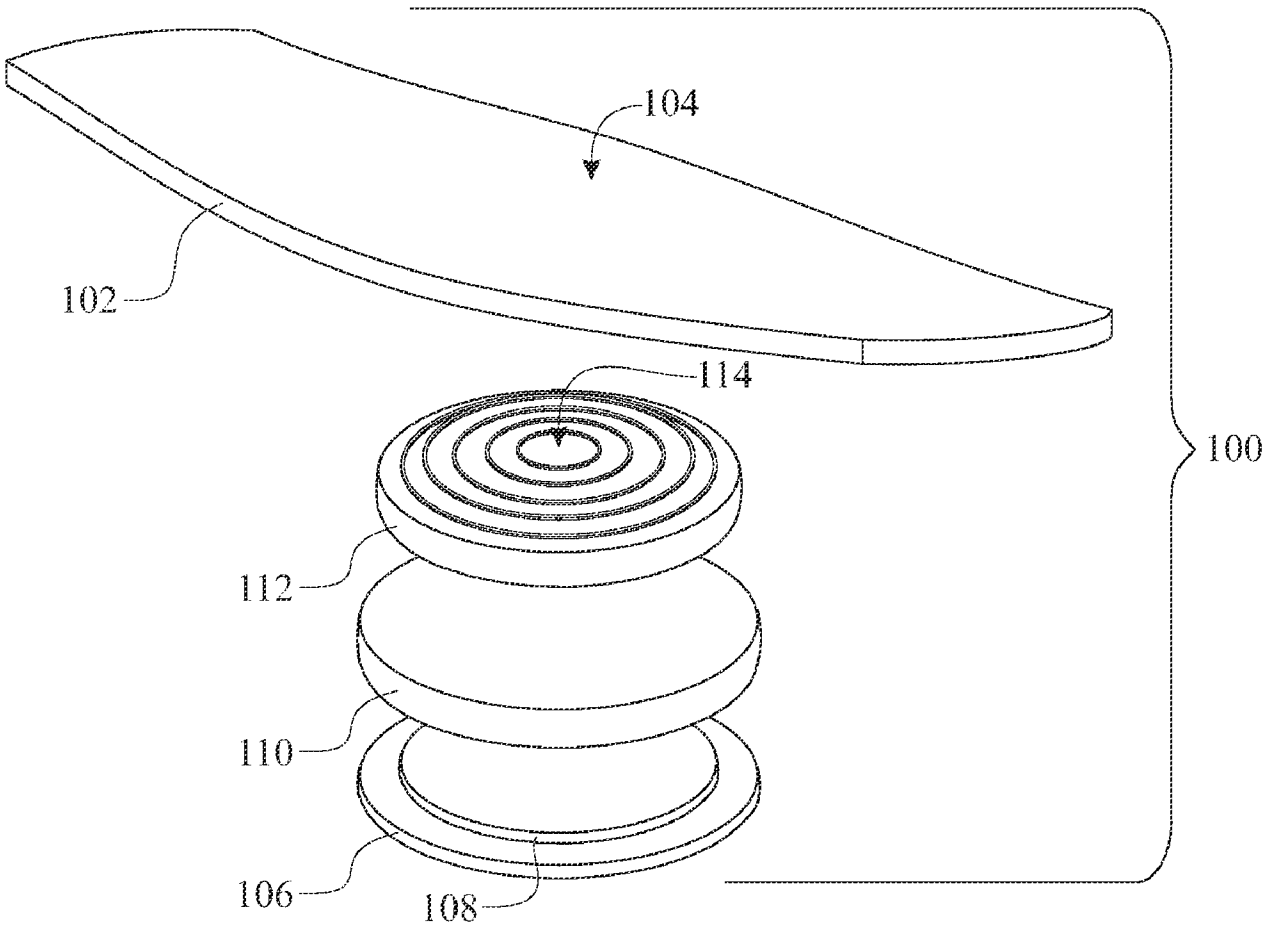
FIG. 1 is an isometric, exploded view illustrating primary elements of a balancing board assembly.

FIG. 1 is an isometric view of an assembly drawing for a balancing board assembly 100. Said balancing board assembly 100 comprising a balancing board 102, said balancing board 102 is placed upon a domed support member upper surface 114 of a domed support member 112. Said domed support member 112 provides a roll and pitch motion to said balancing board 102. Said domed support member 112 is positioned atop a rotational base upper assembly 110. Said rotational base upper assembly 110 is assembled to a rotational base plate 106 and a rotational base 108; said rotational subassembly provides a horizontal rotation for said balancing board 102. In a preferred embodiment, said balancing board assembly 100 is fabricated of plywood. Alternately, said balancing board assembly 100 can be fabricated of other wood types, a polymer, fiberglass covered foam, epoxy covered foam, ABS plastic, and the like. Said balancing board 102 can be finished in any manner, preferably being finished with a unique paint or decal scheme making said balancing board assembly 100 more desirable to the consumer. Said balancing board 102 comprising a balancing board deck surface 104, said balancing board deck surface 104 being a surface in which the user would stand upon. Said balancing board deck surface 104 can incorporate a textured surface or any known surface by those skilled in the art. Said rotational base plate 106 can be fabricated of a sheet of plywood covered with a material, paint, and the like. Said rotational base 108 is a planar bearing assembly similar to a "Lazy Susan" and is fastened to said rotational base plate 106 providing a rotation to said balancing board assembly 100 while said rotational base plate 106 remains stationary. Said rotational base upper assembly 110 is fabricated with a stiff, planar material as a base component, then placing a padded top with a material covering onto the top of the base component. Said rotational base upper assembly 110 is then assembled to a top of said rotational base 108. The general process utilizes screws for assembly of said rotational base plate 106, said rotational base 108, and said rotational base upper assembly 110. Said domed support member 112 is fabricated of a molded or inflatable rubber material. Said domed support member 112 is simply placed upon a top surface of said rotational base upper assembly 110. More details of said domed support member 112 will be described later herein.

Figure 2:
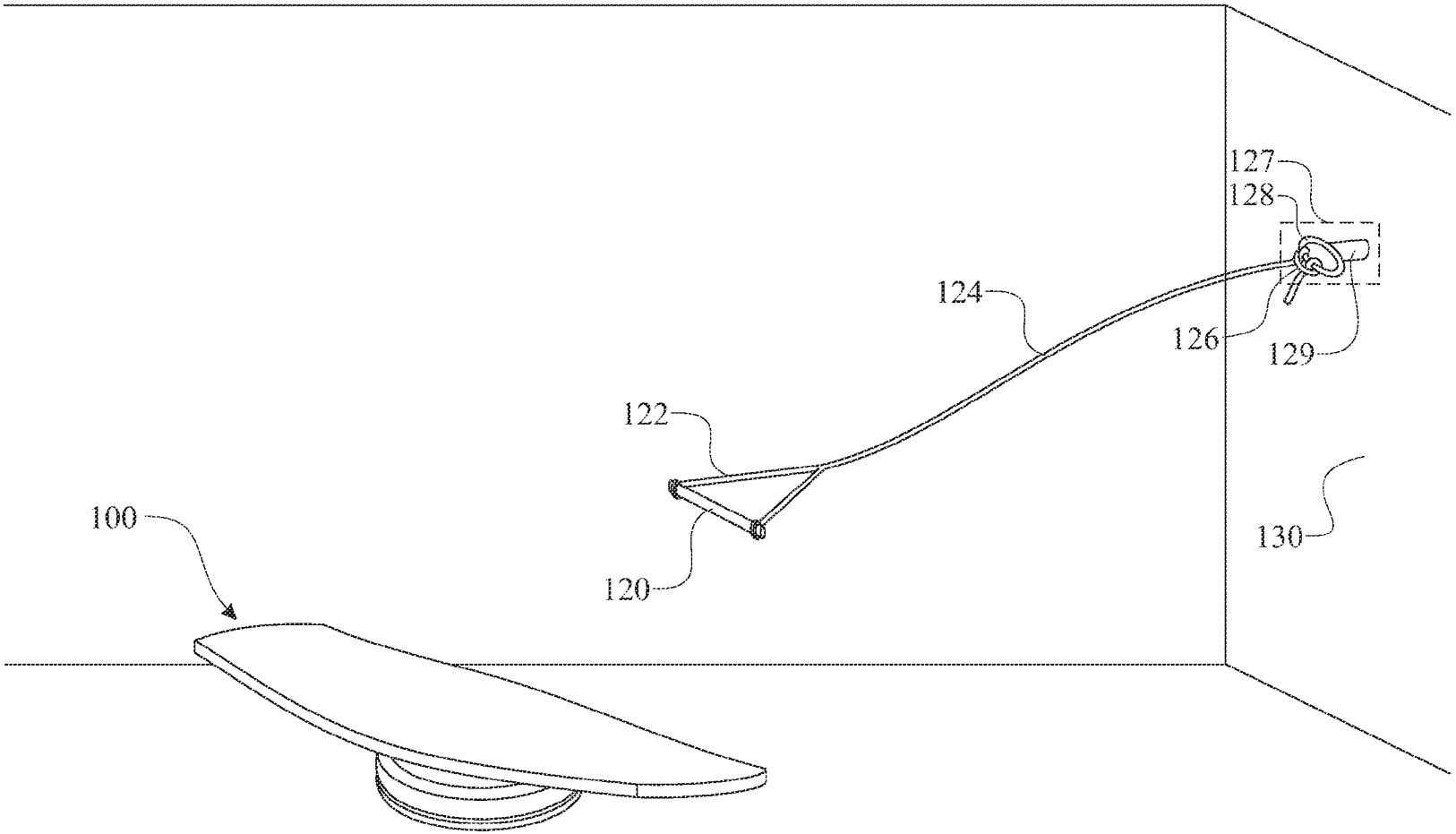
FIG. 2 is an isometric view of a handle toss apparatus in accordance with an exemplary embodiment of the present invention.

FIG. 2 presents a balancing board assembly 100 and a respective handle assembly, said handle assembly comprising a handle 120, a handle rope 122 used to couple said handle 120 to a primary cable 124 and a wall anchor system 127. Said handle 120 simulates a commonly used tow handle and can be fabricated of wood, plastic, composite, metal (such as aluminum), and the like, and would preferably be covered of a soft rubber material for comfort. Said handle 120 can have a cross section that is circular, elliptical, or triangular. Said handle 120 is coupled on each side to said handle rope 122. Said handle rope 122 generally comprising a loop about the center, said loop is used to couple said handle rope 122 to said primary cable 124. Said primary cable 124 can be braided and fabricated of nylon, polypropylene, cotton, and the like. Said primary cable 124 is coupled via a cable coupling 126 to said wall anchor system 127; said wall anchor system 127 comprising a cable coupling ring 128 which is secured to a support wall 130 via a coupling ring wall mount 129. Utilizing a fixed bracket such as said wall anchor system 127, it would be preferable that said primary cable 124 is fabricated of an elastic material, such as an elastic resistance band, bungee cord, rubber, and the like.

Figure 3:
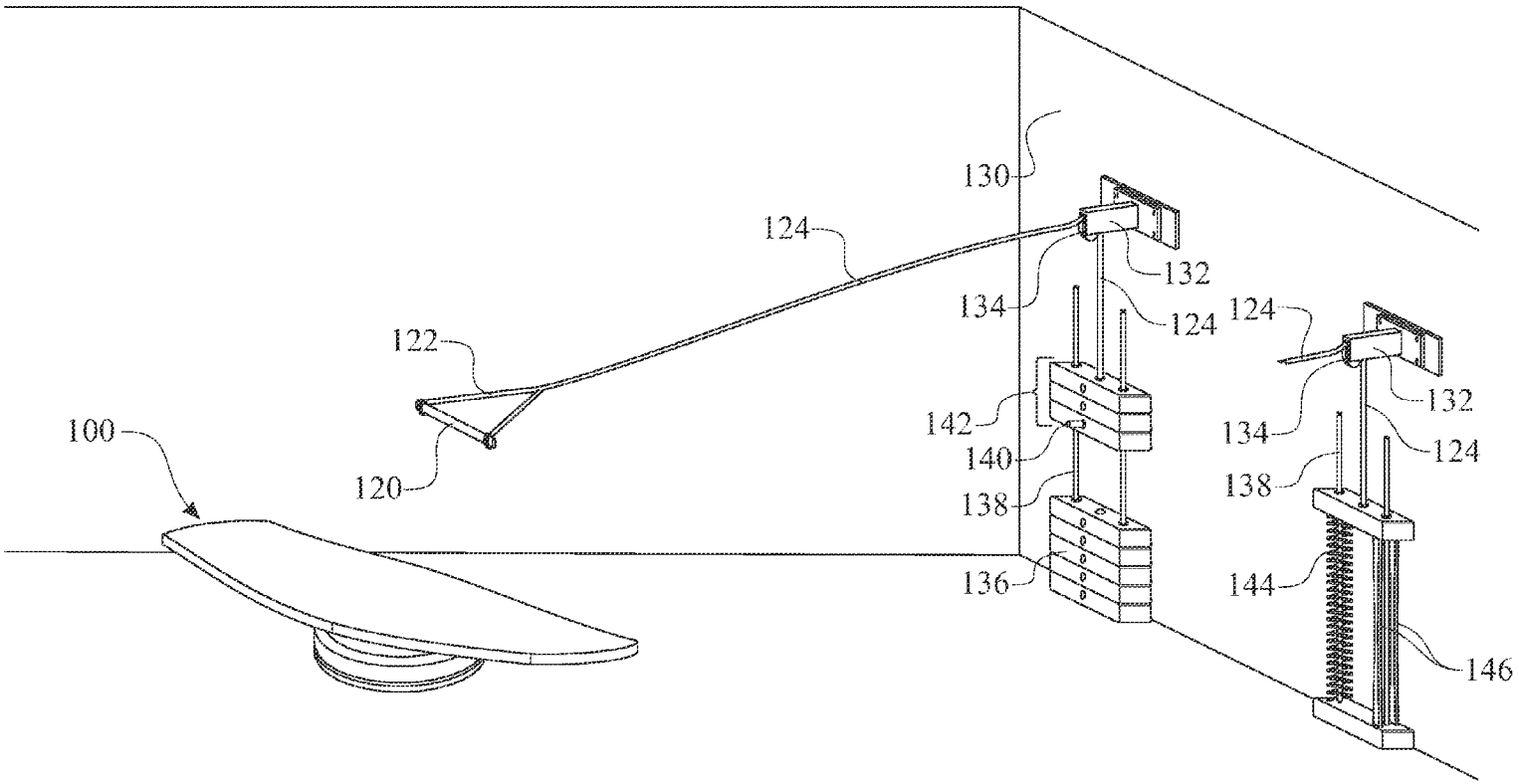
FIG. 3 is an isometric view of a handle toss apparatus in accordance with an alternate exemplary embodiment of the present invention.

FIG. 3 presents an alternate embodiment of FIG. 2, replacing a fixed wall anchor system 127 with a variable weight system, wherein said variable weight system provides the resistance simulating the forces applied by a boat/watercraft, kite, cable pulley system, and the like. Said primary cable 124 would be a non-elastic material and would be placed through a pulley 134, said pulley 134 redirects said primary cable 124 towards a useable weight group 142. Said pulley 134 is coupled to said support wall 130 via a pulley mount 132. Said useable weight group 142 is a plurality of said weighted member(s) 136 which are selectively grouped via a weight selection pin 140 in a manner consistent with a common exercise machine. Said primary cable 124 would be coupled to an object such as weight selection pin 140 in a manner wherein said useable weight group 142 moves respective to any motion or forces applied by said primary cable 124. Said weighted member(s) 136 are contained to a vertical motion via a plurality of weight track 138. The user can adjust the weight in a manner to change the simulated forces as desired. It is understood that other weight adjustment means can be utilizes and such embodiments should not limit the claims of the present invention. One such method would comprise the utilization of fixed or adjustable springs 144 as opposed to the weights. Another such method would comprise the utilization of fixed or adjustable elastic resistance bands 146 as opposed to the weights. Another such method would comprise the spring and dampening system as opposed to the weights.

Figure 4:
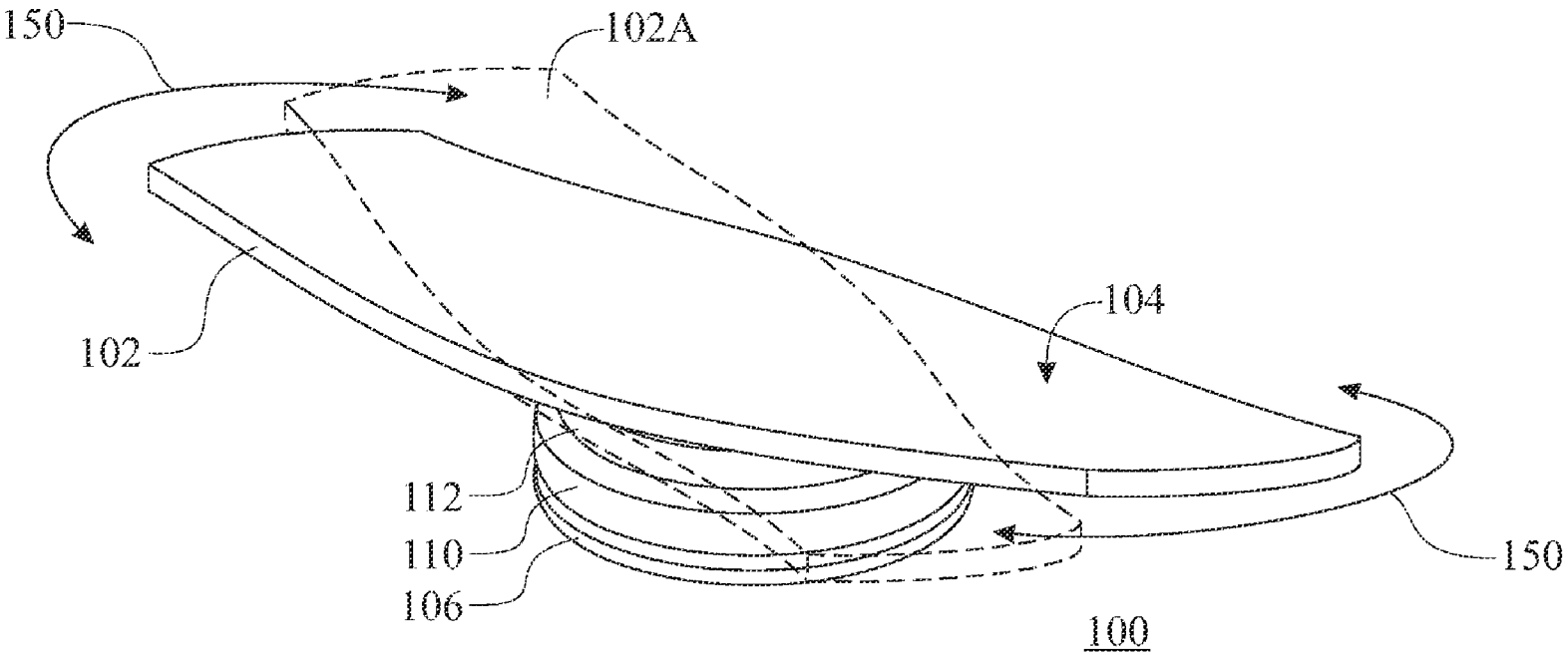
FIG. 4 is an isometric view of said balancing board assembly further illustrating a rotational motion of a balancing board.

FIG. 4 presents an isometric view of said balancing board assembly 100 illustrating a horizontal rotation 150 of said balancing board 102. The user would stand upon said balancing board deck surface 104 of said balancing board 102. Any twisting action of the user generates a horizontal rotation 150 of said balancing board 102, moving said balancing board 102 to a position indicated as balancing board 102A. Said rotation is provided by said rotational base 108 (shown in FIG. 1), wherein said rotational base plate 106 remains stationary, said rotational base 108 is free to rotation about a horizontal plane. Then said rotational base upper assembly 110, said domed support member 112, and said balancing board 102 rotate as a single motion.

Figure 5:
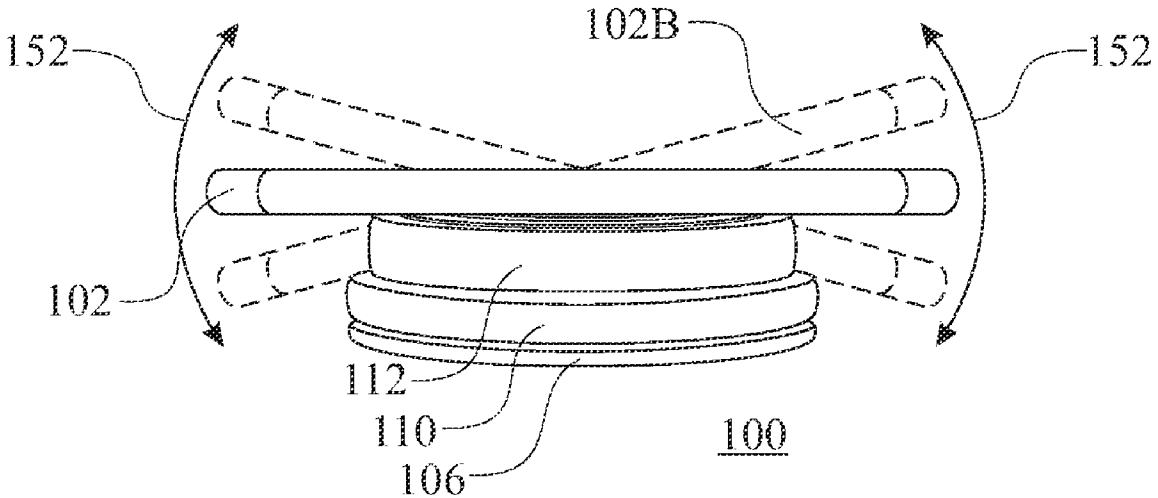
FIG. 5 is a side view of said balancing board assembly illustrating a rolling motion of said balancing board.

FIG. 5 presents a side view of said balancing board assembly 100 illustrating a latitudinal roll 152 about a longitudinal axis (along the longer length of said board) of said balancing board 102. The user would stand upon said balancing board deck surface 104 of said balancing board 102. Any front to back rolling action (roll) of the user generates said latitudinal roll 152 of said balancing board 102, moving said balancing board 102 to a position indicated as balancing board 102B. Said rolling is provided by said domed support member 112 placed upon said rotational base upper assembly 110.

Figure 6:
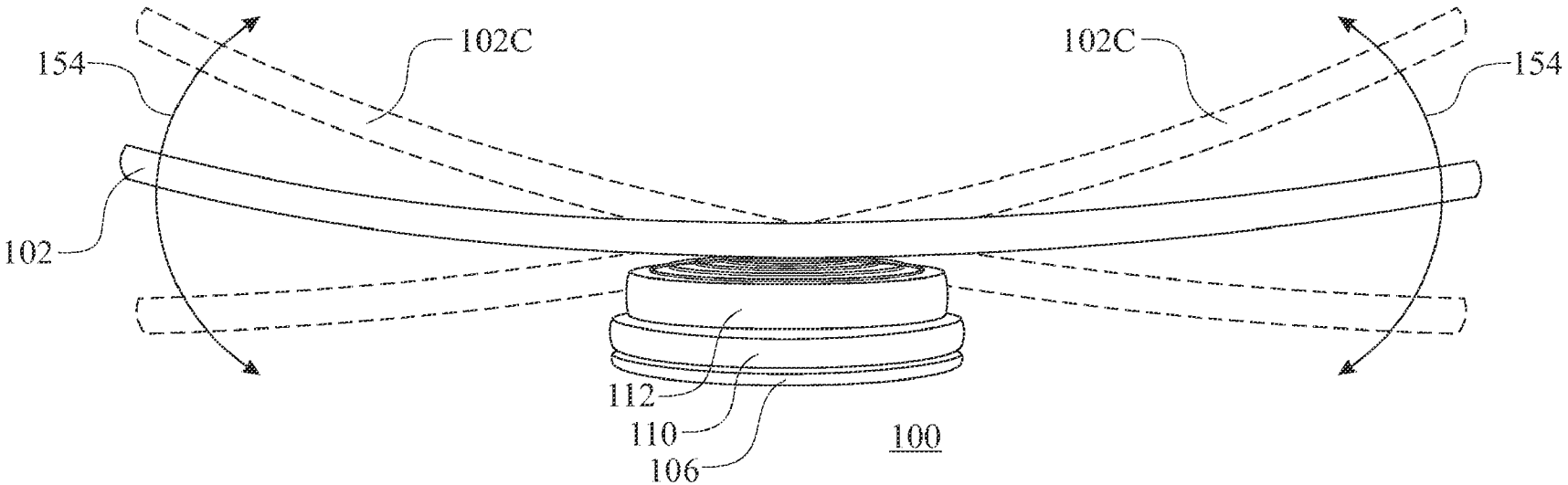
FIG. 6 is a front view of said balancing board assembly illustrating a pitching motion of said balancing board.

FIG. 6 presents a front view of said balancing board assembly 100 illustrating a longitudinal pitch 154 about a latitudinal axis (along the shorter length of said board) of said balancing board 102. The user would stand upon said balancing board deck surface 104 of said balancing board 102. Any side to side rolling action (pitch) of the user generates said longitudinal pitch 154 of said balancing board 102, moving said balancing board 102 to a position indicated as balancing board 102C. Said pitch is provided by said domed support member 112 placed upon said rotational base upper assembly 110.

Figure 7:
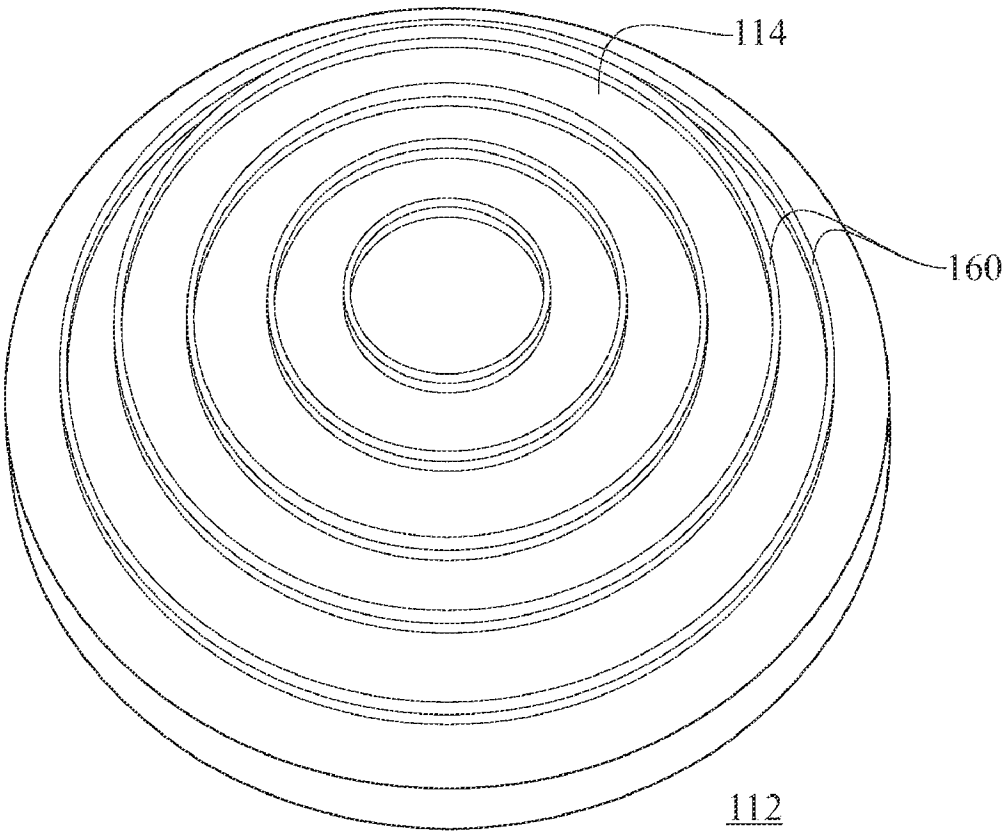
FIG. 7 is a three dimensional, top view of a dome shaped support member.

FIG. 7 presents a three-dimensional, top view introducing additional details of said domed support member 112. Said domed support member 112 comprises a domed support member upper surface 114 and a slip minimizing, textured design, preferably a plurality of domed support member rib(s) 160. Said domed support member rib(s) 160 are presented as series of rings about a center of said domed support member upper surface 114 as a means for ensuring said balancing board 102 does not slip off said domed support member 112. Alternate slip minimizing designs can be utilized such as a plurality of ribs and a plurality of protrusions.

Figure 8:
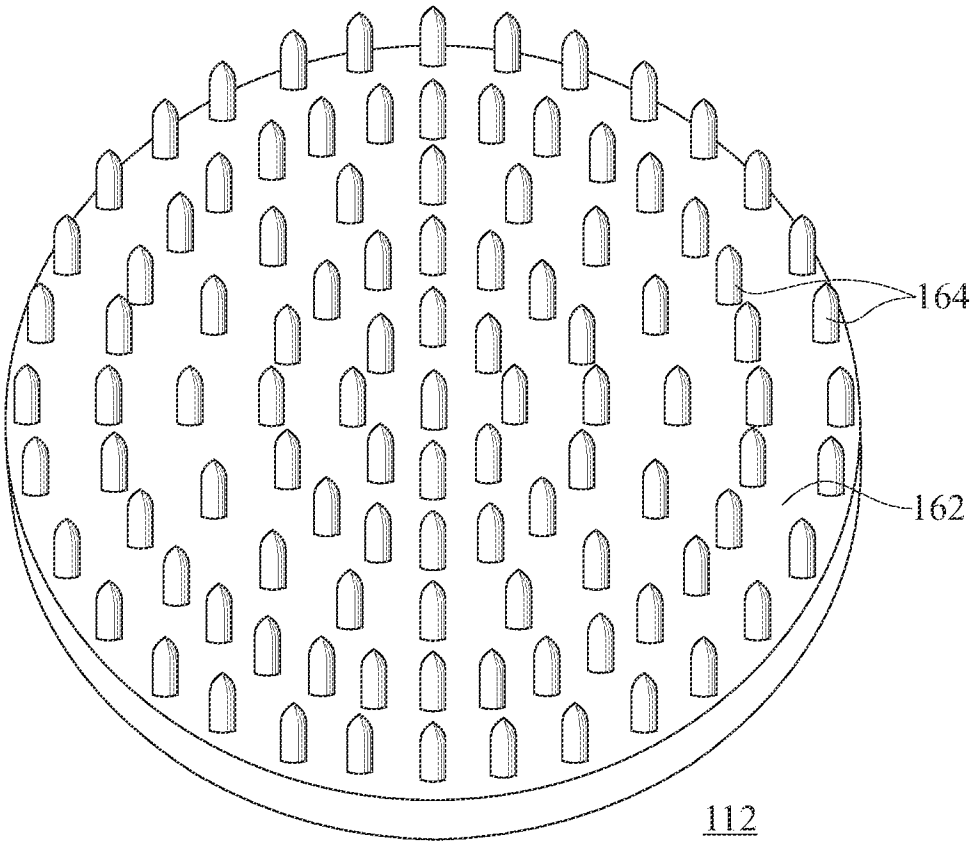
FIG. 8 is a three dimensional, bottom view of a dome shaped support member.

FIG. 8 presents a three-dimensional, bottom view introducing additional details of said domed support member 112. Said domed support member 112 comprising a domed support member bottom surface 162 and a slip minimizing, textured design, preferably a plurality of domed support member protrusion(s) 164. Said plurality of domed support member protrusion(s) 164 are preferably distributed evenly about said domed support member bottom surface 162 and provide a gripping interface between a bottom surface of said domed support member 112 and top surface of said rotational base upper assembly 110.

Figure 9:
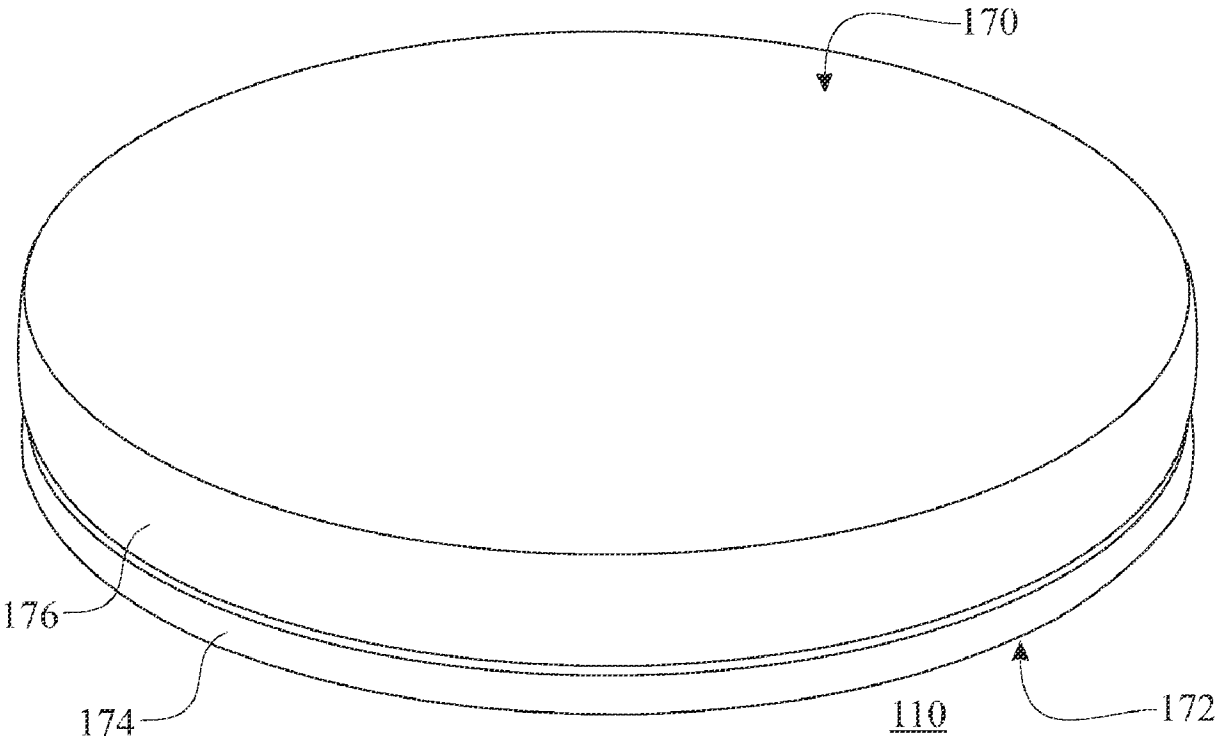
FIG. 9 is a three dimensional, top view of a rotational base upper assembly.

FIG. 9 presents a three-dimensional, top view introducing additional details of said rotational base upper assembly 110. Said rotational base upper assembly 110 comprising a rotational base upper plate 174, wherein said rotational base upper plate 174 provides a rigid base. Said rotational base upper assembly 110 furthering comprising a rotational base upper padding 176, wherein said rotational base upper padding 176 provides a pliable upper surface for a rotational base upper member top 170. Said rotational base upper padding 176 is fabricated of foam. Said rotational base upper padding 176 is placed upon (and optionally fastened to using adhesive) the base material of said rotational base upper plate 174. The subassembly is then covered with a fabric, which is stretched over the foam and base material, then tacked to the base material such as by staples. Said rotational base upper assembly 110 is then fastened to a top surface of said rotational base 108 proximate a rotational base upper member bottom 172. Holes can be provided within said rotational base plate 106 providing access for securing said rotational base upper assembly 110 and rotational base 108 to each other. One such means for fastening said rotational base 108 and rotational base upper assembly 110 would be via screws.

Figure 10:
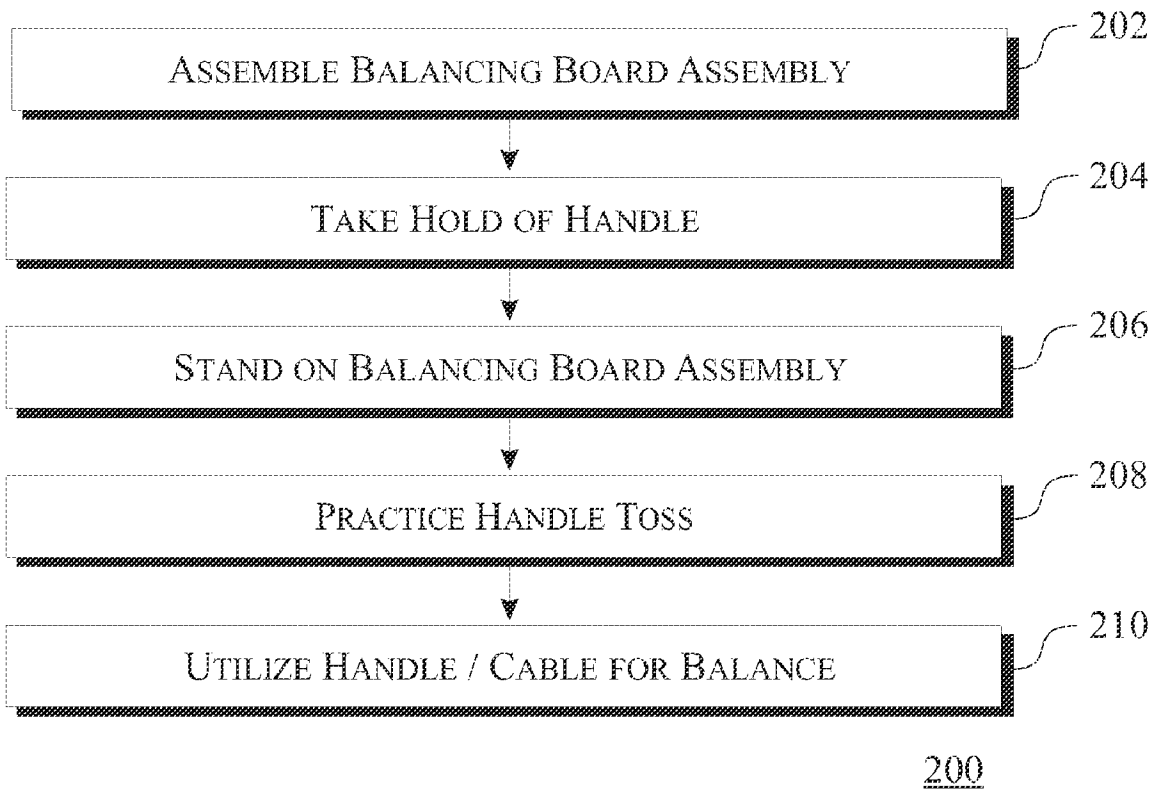
FIG. 10 is a handle toss training method flow diagram.

FIG. 10 presents a handle toss training method 200, said handle toss training method 200 initiating with a balancing board assembly step 202. Said balancing board assembly step 202 is accomplished via assembling said balancing board assembly 100 as described in FIG. 1. The user then grabs hold of said handle 120 in accordance with a take hold of the handle step 204. The user then walks over and steps onto said balancing board deck surface 104 of said balancing board assembly 100 as directed in a stand on balancing board assembly step 206. At this point, the user is ready to being practicing the handle-toss. The user leans, twists, and turns while standing upon said balancing board deck surface 104 and consequently passes said handle 120 between a first hand and a second hand, in accordance with a handle toss practice step 208. While practicing, the user utilizes said handle 120 and tension applied via said primary cable 124 as a support for balance during maneuvers, as directed by a utilization of said handle/cable for balancing step 210.

Figure 11:
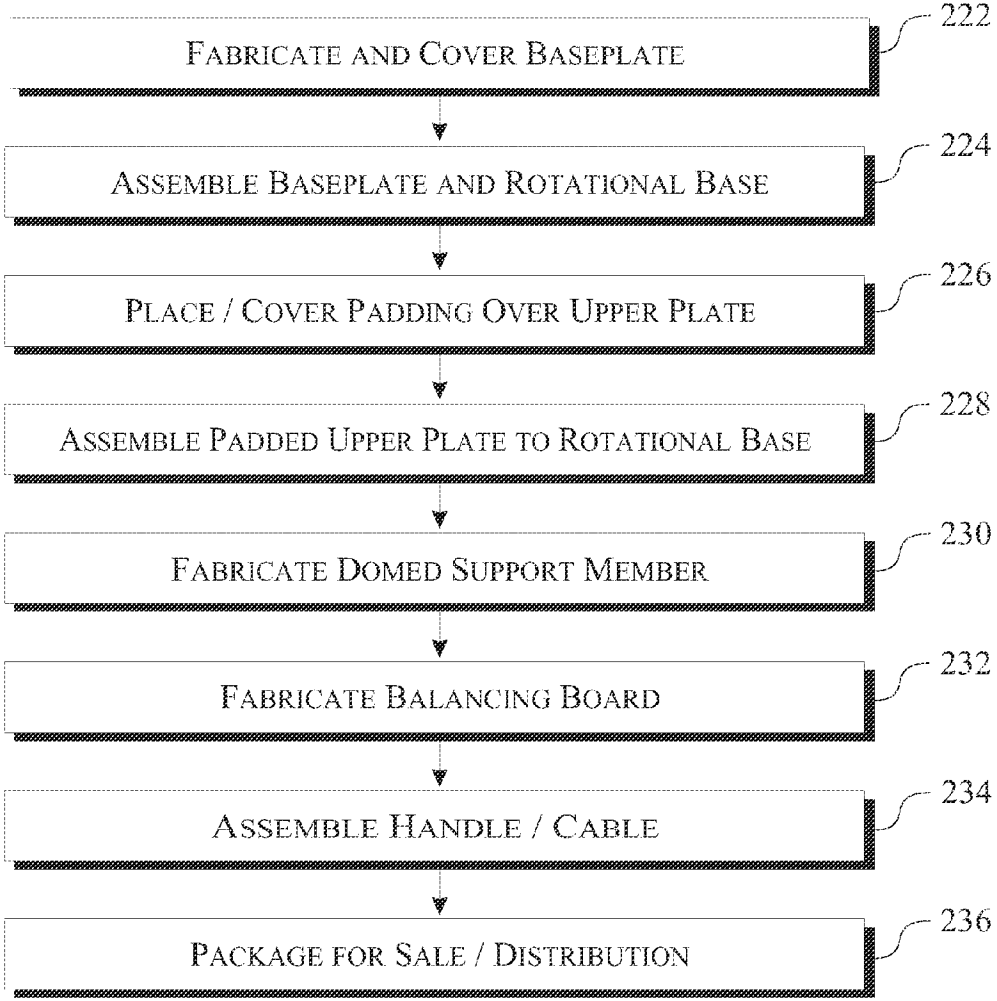
FIG. 11 is a balancing board assembly flow diagram.

FIG. 11 presents a handle toss training apparatus assembly flow 220, said handle toss training apparatus assembly flow 220 presents the various steps for fabrication of a handle toss training system. Said handle toss training apparatus assembly flow 220 initiates with a fabrication and finishing said base plate step 222. Said rotational base plate 106 is fabricated by cutting a piece of base plate material (such as plywood) to shape. Said rotational base plate 106 is then covered with the desired finish, such as covering with a material. Continuing with the assembly, a base plate and rotating base assembly step 224 is accomplished via fastening said covered rotational base plate 106 to said rotational base 108. Said rotational base upper assembly 110 is then assembled in accordance with a couple padding to a rotational upper plate assembly step 226. Said padding onto a rotational upper plate assembly step 226 is accomplished via placing or adhering said rotational base upper padding 176 onto a rotational base upper plate 174, then covered with a material to provide said rotational base upper assembly 110. Upon completion of the fabrication said rotational base upper assembly 110, said rotational base upper assembly 110 is assembled to a topside of said rotational base 108 via an upper plate and rotational base assembly step 228. Said domed support member 112 is fabricated in accordance with a domed support member fabrication step 230. Said domed support member 112 can be fabricated utilizing any rubber molding process, inflatable forming process, and the like. Said balancing board 102 is fabricated in accordance with a balancing board fabrication step 232 via any known board fabrication process. Such balancing board fabrication processes include, shaping plywood, shaping foam, then covering with a composite material (fiberglass, epoxy, and the like), plastic molding process, and the like. The last fabrication step, fabrication and assembly of a handle and cable step 234 is accomplished in accordance with commonly known ski-handle fabrication methods. Said handle 120 is fabricated of a plastic, metal (such as aluminum), composite, and the like. Said handle 120 can be formed via an extrusion, molding, or machining process. Said handle rope 122 is woven and coupled to said handle 120. The coupling section between said handle rope 122 and said handle 120 can optionally be covered in a molded rubber. Additionally, said handle 120 is preferably covered with a soft coating such as rubber, silicone, Urethane, polyethylene, leather, and the like. Said primary cable 124 is fabricated via any desired material, selected based upon the embodiment of the tension mechanism. Said tension mechanism is fabricated in accordance with the design selected and would be understood by those skilled in the art. The finished components are then packaged for sale and distribution in accordance with a package for sale and distribution step 236.

The teachings herein depict the preferred embodiment of the present invention. It can be recognized that although the illustration and specification specifically presents a handle toss training apparatus as described herein, alternative embodiments that are natural deviations by those skilled in the art can be utilized while maintaining the spirit and intent of the present invention.

What is claimed:

1. A handle toss training apparatus, said handle toss training apparatus comprising:

a rotational base assembly, adapted to rest upon a support surface, comprising a stationary base plate fastened to a bottom of a rotational base allowing for rotation there between and a rotational upper plate fastened to a top of said rotational base;

said rotational upper plate comprising a padded top section;

a domed support member placed upon said rotational upper plate; and a balance board placed upon the domed support member.

2. The handle toss training apparatus of claim 1, said domed support member further comprising a slip minimizing, textured top section.

3. The handle toss training apparatus of claim 2, wherein said slip minimizing, textured top section of said domed support member is at least one of a plurality of ribs, a plurality of rings, or a plurality of protrusions.

4. The handle toss training apparatus of claim 1, said domed support member further comprising a slip minimizing, textured bottom section.

5. A handle toss training apparatus, said handle toss training apparatus comprising:

a rotational base assembly, adapted to rest upon a support surface, comprising a stationary base plate fastened to a bottom of a rotational base allowing for rotation there between and a rotational upper plate fastened to a top of said rotational base;

a domed support member, having at least one of a slip minimizing, textured top section and a slip minimizing, textured bottom section, placed upon said rotational upper plate; and a cable comprising a handle coupled to a first end of said cable designed to obtain a tensile force from a wall mount at a location distant from said first end; and a balance board placed upon the domed support member.

6. The handle toss training apparatus of claim 5, wherein a cable is fastened to said wall mount.

7. The handle toss training apparatus of claim 6, wherein said cable is fabricated of a stretchable material.

8. The handle toss training apparatus of claim 7, said wall mount further comprising a pulley, wherein said cable passes over said pulley and said tensile force is obtained by coupling said cable to a resistance force.

9. The handle toss training apparatus of claim 8, said resistance force being provided by at least one of a spring, an elastic resistance member, a spring and dampening device, a weight, or a group of weights.

10. The handle toss training apparatus of claim 8, said resistance force being provided by at least one of an adjustable spring or a plurality of weighted members allowing the user to select a specific weight.

11. The handle toss training apparatus of claim 5, said rotational upper plate further comprising a padded top section.

12. A handle toss training apparatus, said handle toss training apparatus comprising:

at least one of:

a rotational base assembly, adapted to rest upon a support surface, comprising a stationary base plate fastened to a bottom of a rotational base allowing for rotation there between and a rotational upper plate fastened to a top of said rotational base, and a domed support member having at least one of a slip minimizing, textured top section and a slip minimizing, textured bottom section; wherein said domed support member is placed upon said rotational upper plate;

a cable comprising a handle coupled to a first end of said cable designed to obtain a tensile force from a wall mount at a location distant from said first end; and a balance board placed upon the domed support member.

13. The handle toss training apparatus of claim 12, wherein said cable is fastened to a wall mount.

14. The handle toss training apparatus of claim 13, wherein said cable is fabricated of a stretchable material.

15. The handle toss training apparatus of claim 12, said wall mount further comprising a pulley, wherein said cable passes over said pulley and said tensile force is obtained by coupling said cable to a resistance force.

16. The handle toss training apparatus of claim claim 15, said resistance force being provided by at least one of a spring, an elastic resistance member, a spring and dampening device, a weight, or a group of weights.

17. The handle toss training apparatus of claim 12, wherein, said rotational upper plate further comprising a padded top section.

* * * * *